US007946798B2

(12) United States Patent
Anderson et al.

(10) Patent No.: US 7,946,798 B2
(45) Date of Patent: May 24, 2011

(54) CASING AND ROD HANDLER

(76) Inventors: Vaughn J. Anderson, Courtenay (CA); Kenneth Anderson, Courtenay (CA)

( * ) Notice: Subject to any disclaimer, the term of this patent is extended or adjusted under 35 U.S.C. 154(b) by 340 days.

(21) Appl. No.: 12/202,718

(22) Filed: Sep. 2, 2008

(65) Prior Publication Data

US 2010/0054895 A1 Mar. 4, 2010

(51) Int. Cl.
*B65G 7/10* (2006.01)
*B66F 11/00* (2006.01)

(52) U.S. Cl. ..... 414/589; 414/746.5; 414/910; 138/113

(58) Field of Classification Search ..... 175/85, 175/203; 405/231–232; 414/22.51–22.52, 414/22.54–22.59, 22.61–22.62, 22.71, 23–24, 414/745.4–745.5, 919, 27, 746.8, 910, 745.2; 52/125.2; 89/1.802, 1.805; 138/113–114; 166/379–380, 378, 77.51
See application file for complete search history.

(56) References Cited

U.S. PATENT DOCUMENTS

| | | | | | |
|---|---|---|---|---|---|
| 1,583,486 | A * | 5/1926 | Paige | 414/746.5 |
| 2,848,196 | A * | 8/1958 | Simmonds | 175/52 |
| 3,494,484 | A * | 2/1970 | McFadden | 414/22.57 |
| 3,729,102 | A * | 4/1973 | Shumaker | 414/746.8 |
| 3,795,326 | A * | 3/1974 | Neilon et al. | 414/22.58 |
| 3,805,902 | A * | 4/1974 | Storm et al. | 175/85 |
| 4,129,221 | A * | 12/1978 | Moller | 414/22.57 |
| 4,253,792 | A * | 3/1981 | Nishikawa | 414/589 |
| 4,310,281 | A * | 1/1982 | Egashira | 414/433 |
| 5,174,389 | A * | 12/1992 | Hansen | 175/52 |
| 7,090,035 | B2 * | 8/2006 | Lesko | 175/57 |
| 7,246,987 | B2 * | 7/2007 | Jagos et al. | 414/754 |
| 2006/0243488 | A1 * | 11/2006 | Pietras | 175/52 |

* cited by examiner

*Primary Examiner* — Gregory W Adams
(74) *Attorney, Agent, or Firm* — Barnes & Thornburg LLP

(57) ABSTRACT

A casing pipe and drill rod handler for joining the drill rod in a casing pipe. A pipe sled is provided on a drilling rig, the pipe sled comprising an elongated track with a cart slidably mounted on the track to accommodate the casing pipe. A drill rod guide is provided at one end of the track to guide a drill rod as it is positioned and then inserted into the casing pipe.

4 Claims, 7 Drawing Sheets

CASING AND ROD HANDLER

BACKGROUND OF THE INVENTION

This invention relates to well drilling apparatus, and in particular to a casing and rod handler for inserting a drill rod into a casing pipe so that the combination can be used as a well is drilled.

As a well is being drilled, casing is driven into the ground as the well bore extends downwardly. A drill rod is inserted through the casing to the drill bit as the drilling progresses. Periodically, additional lengths of casing pipe and drill rod must be added to the drill string to continue the drilling process.

The purpose of the invention is to simplify the process of installing a drill rod into a casing pipe so that the combination is ready for use.

SUMMARY OF THE INVENTION

The invention is directed to a casing pipe and drill rod handler. It first includes a pipe sled comprising an elongated track with a cart mounted on the track and slidable on the track between opposite ends of the track. A drill rod guide is located at one end of the track. The drill rod guide is mounted in registration with the one end of the track, the drill rod guide being formed to register one end of a drill rod inserted in the drill rod guide with a casing pipe located on the pipe sled. A fixed pipe support is provided, aligned with the track and proximate the drill rod guide.

The drill rod guide includes opposite vertical sides which are spaced to accommodate a drill rod located between the sides. The sides may be of a desired height to help guide the drill rod as it is oriented in relation to the casing pipe.

In the method according to the invention of preloading a drill rod into a casing pipe, first a length of casing pipe is oriented in a substantially horizontal position with a drill rod guide proximate one end of the casing pipe. Then, a drill rod is positioned in a generally vertical orientation with one end in the drill rod guide. The drill rod is then lowered to a substantially horizontal position with its one end remaining in the drill rod guide until the drill rod and the casing pipe are substantially coextensive. Then, finally, the drill rod is slid through the drill rod guide and into the casing pipe. Thereafter, the combined casing pipe and drill rod can be removed, and the process can be repeated for providing multiple combinations of casing pipes and drill rods.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
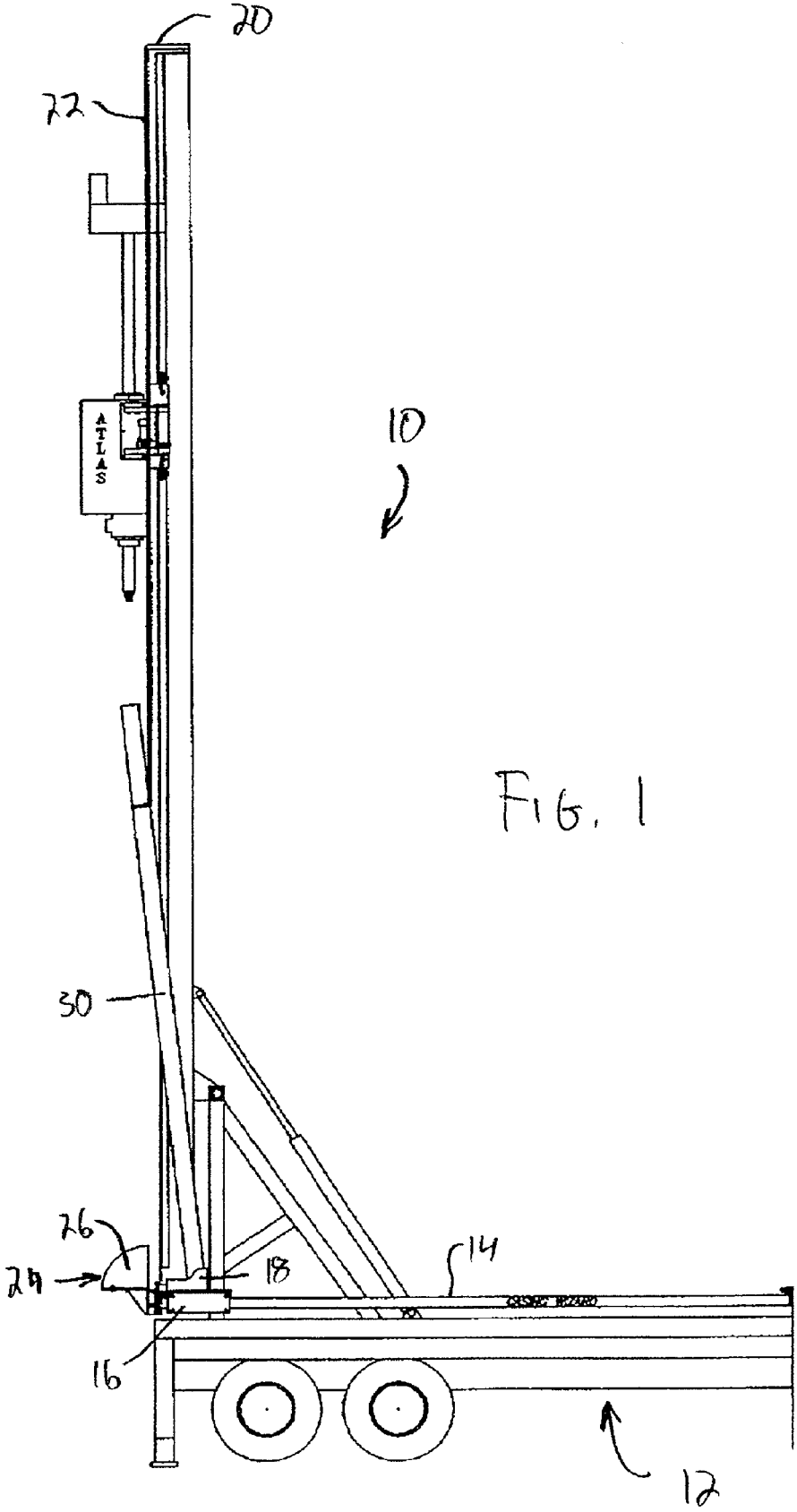
FIG. 1 illustrates the invention in combination with a drill rig and illustrates a casing first lifted substantially vertically with one end in the cart of the pipe sled.

A casing and rod handler according to the invention is shown generally at 10 in the drawing figures. The invention is used with and mounted on a typical drill rig 12, which is well known to those skilled in the art, and is therefore not described in particular detail.

The casing and rod handler 10 according to the invention is mounted on a horizontal bed of the drill rig 12, and includes a pipe sled comprising an elongated track 14 with a cart 16 mounted on the track and slidable on the track between opposite ends of the track 14. As illustrated, the cart 16 includes a seat 18 in which one end of a casing pipe is inserted. Used in connection with the invention is the top head winch 20 of the drill rig 12, the top head winch 20 including a winch cable 22 used in connection with the invention. The top head winch 20 is conventional, and therefore is not described in greater detail.

The casing and rod handler 10 also includes a drill rod guide 24 which is fixed on the drill rig 12 at one end of the track 14. The drill rod guide 24 includes opposite vertical sides 26 (only one side being shown) which are spaced sufficiently to allow a drill rod to pass between the sides 26. As illustrated, the drill rod guide 24 is mounted in registration with one end of the track 14 to guide insertion of a drill rod into a pipe casing, as explained below.

For support of a casing pipe on the pipe sled, the invention further includes a fixed pipe support 28 aligned with the track 14 and proximate the drill rod guide 24. Preferably the fixed pipe support 28 is configured to cradle a casing pipe when the casing pipe is seated in the fixed pipe support 28.

Figure 2:
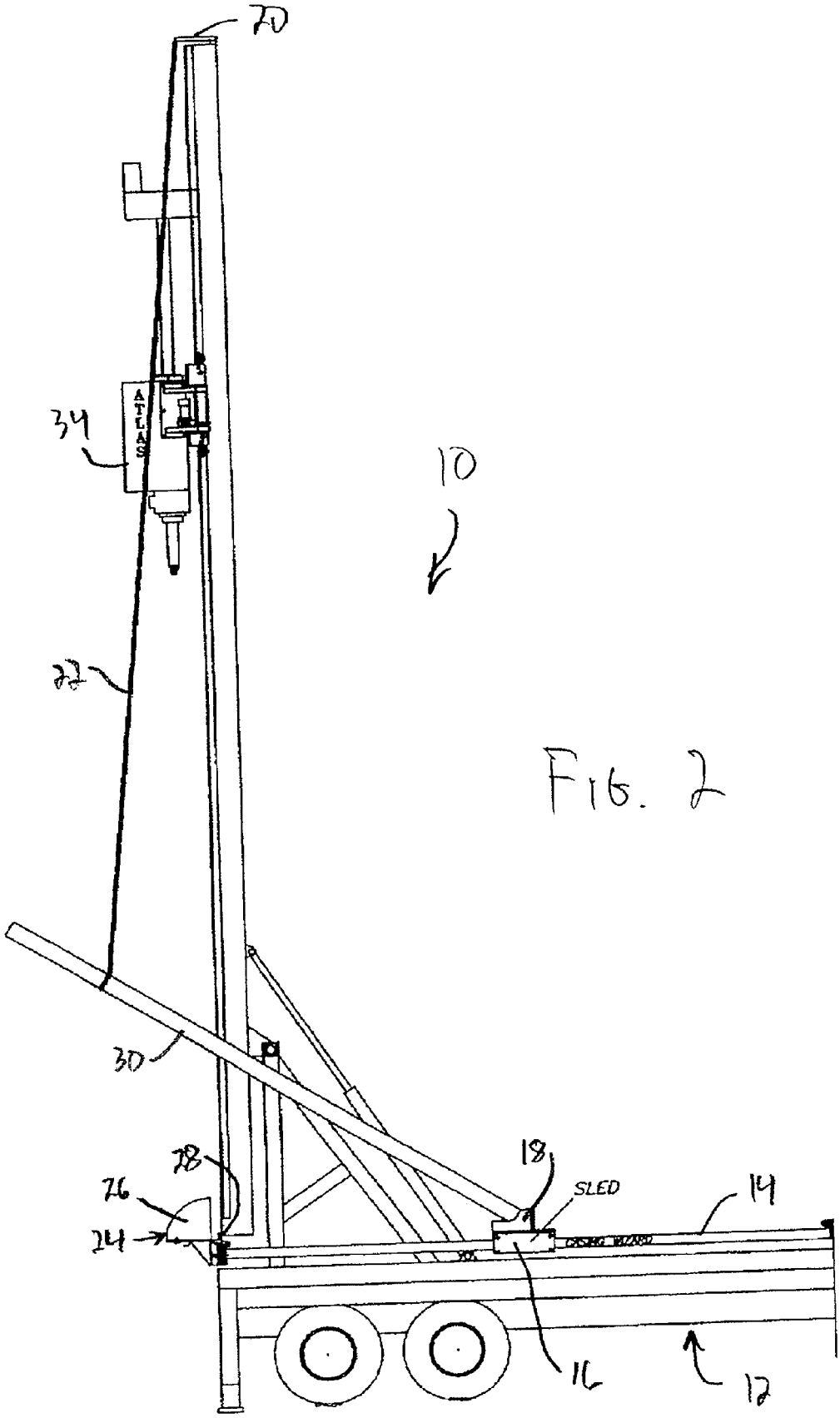
FIG. 2 shows the casing pipe being lowered to the horizontal orientation with the top head winch of the drilling rig, while the cart is sliding on the track of the pipe sled.

In use, an operator first affixed the winch cable 22 of the top head winch 20 to a length of casing pipe 30. The operator then orients the casing pipe 30 one end in the seat 18 of the cart 16. The casing pipe is then lowered as shown successively in FIGS. 1 through 3 as the cart 16 moves from one end of the track 14 to its opposite end, and is seated in the fixed pipe support 28.

Figure 3:
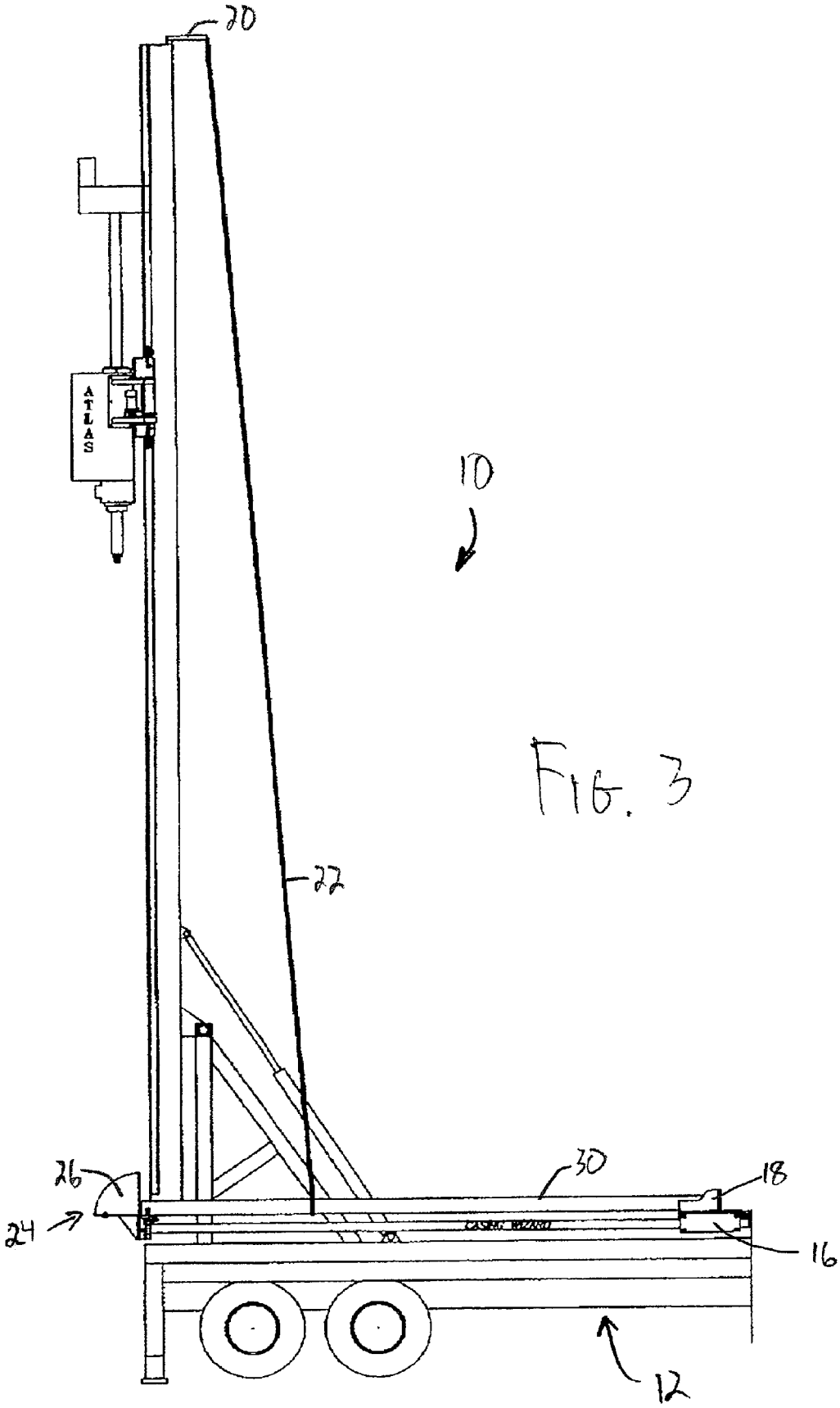
FIG. 3 illustrates final positioning of the casing pipe in a horizontal orientation on the pipe sled.
Figure 4:
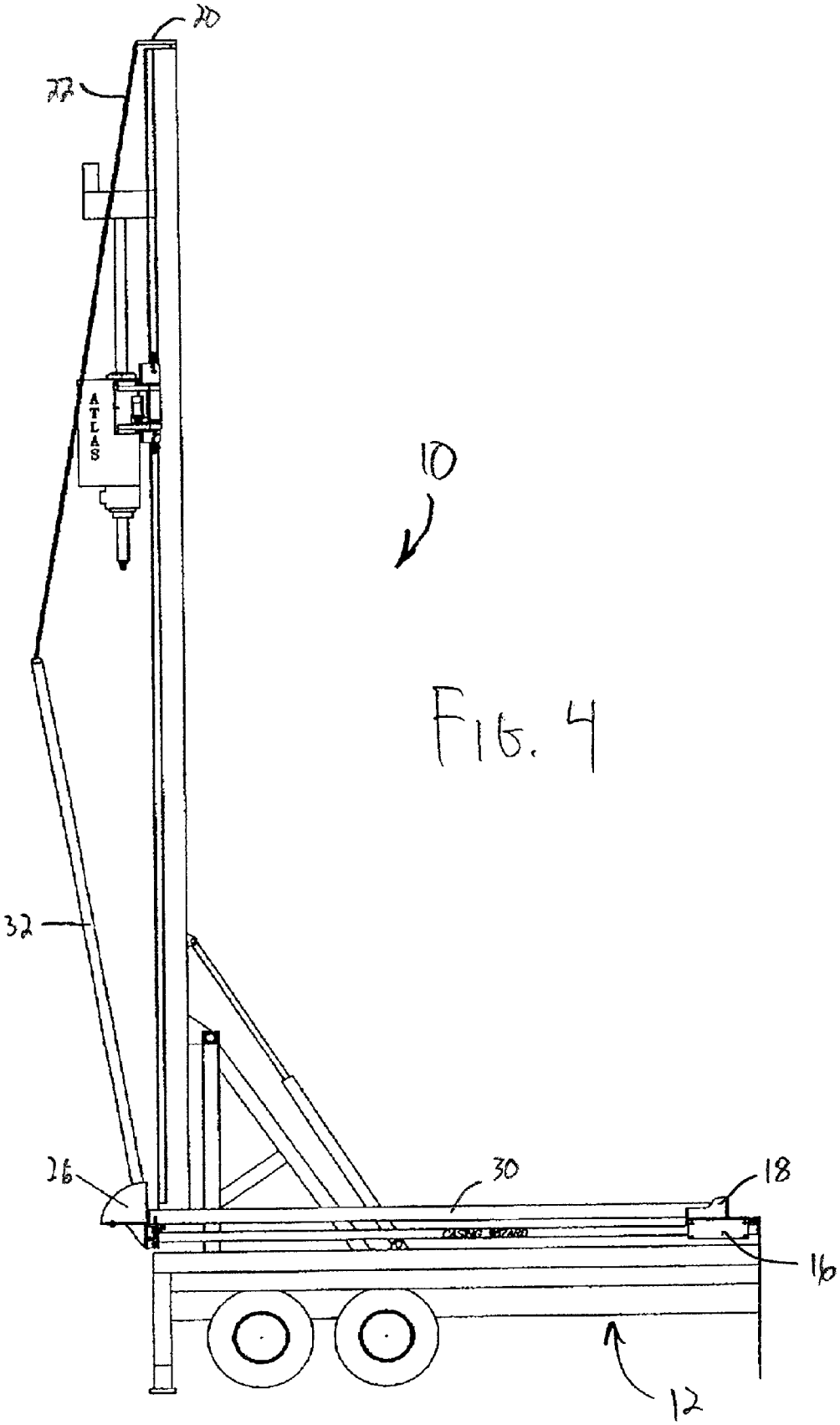
FIG. 4 illustrates use of the top head winch to orient a drill rod substantially vertically with one end in the drill rod guide.
Figure 5:
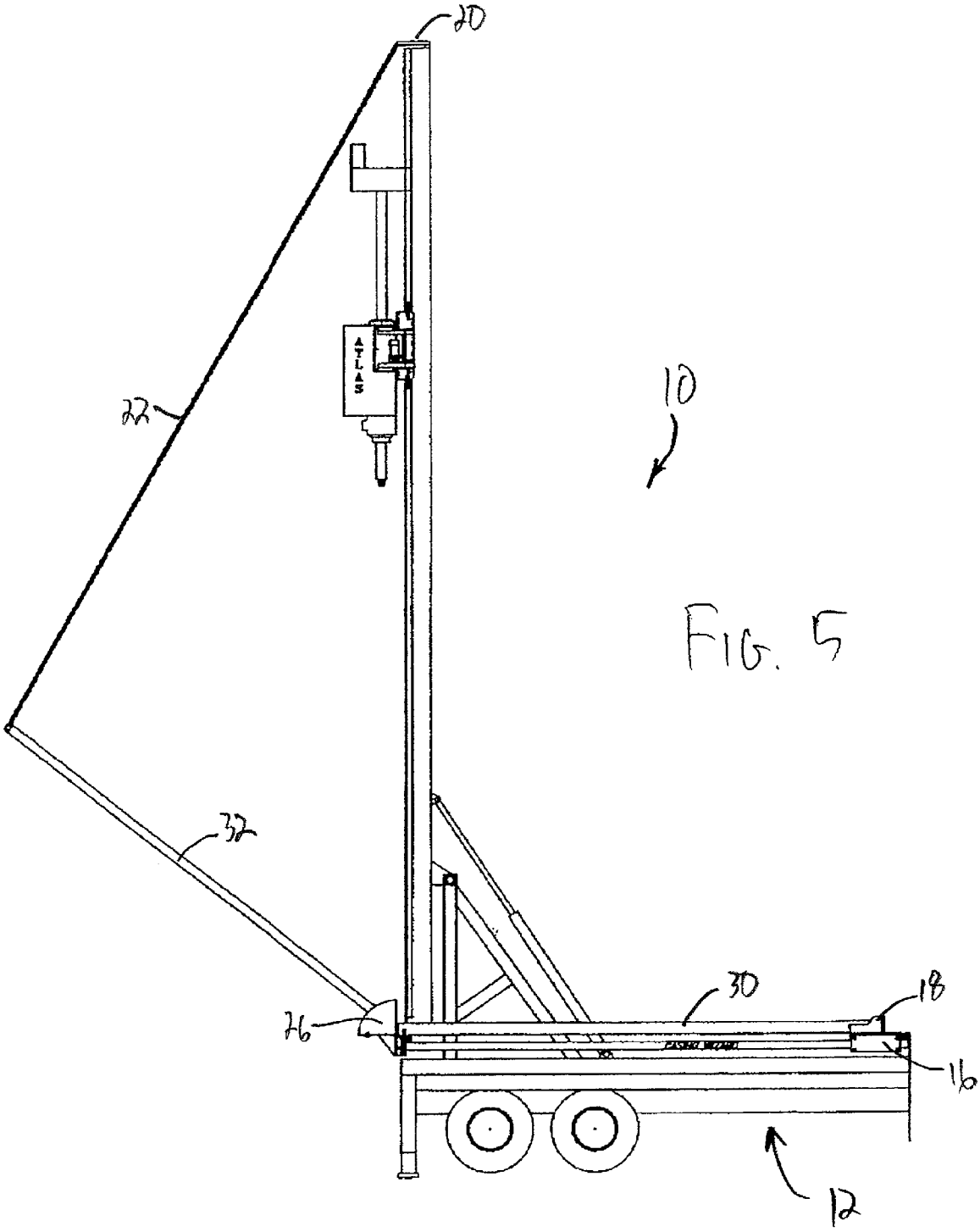
FIG. 5 illustrates use of the top head winch to begin lowering the drill rod to a horizontal orientation.
Figure 6:
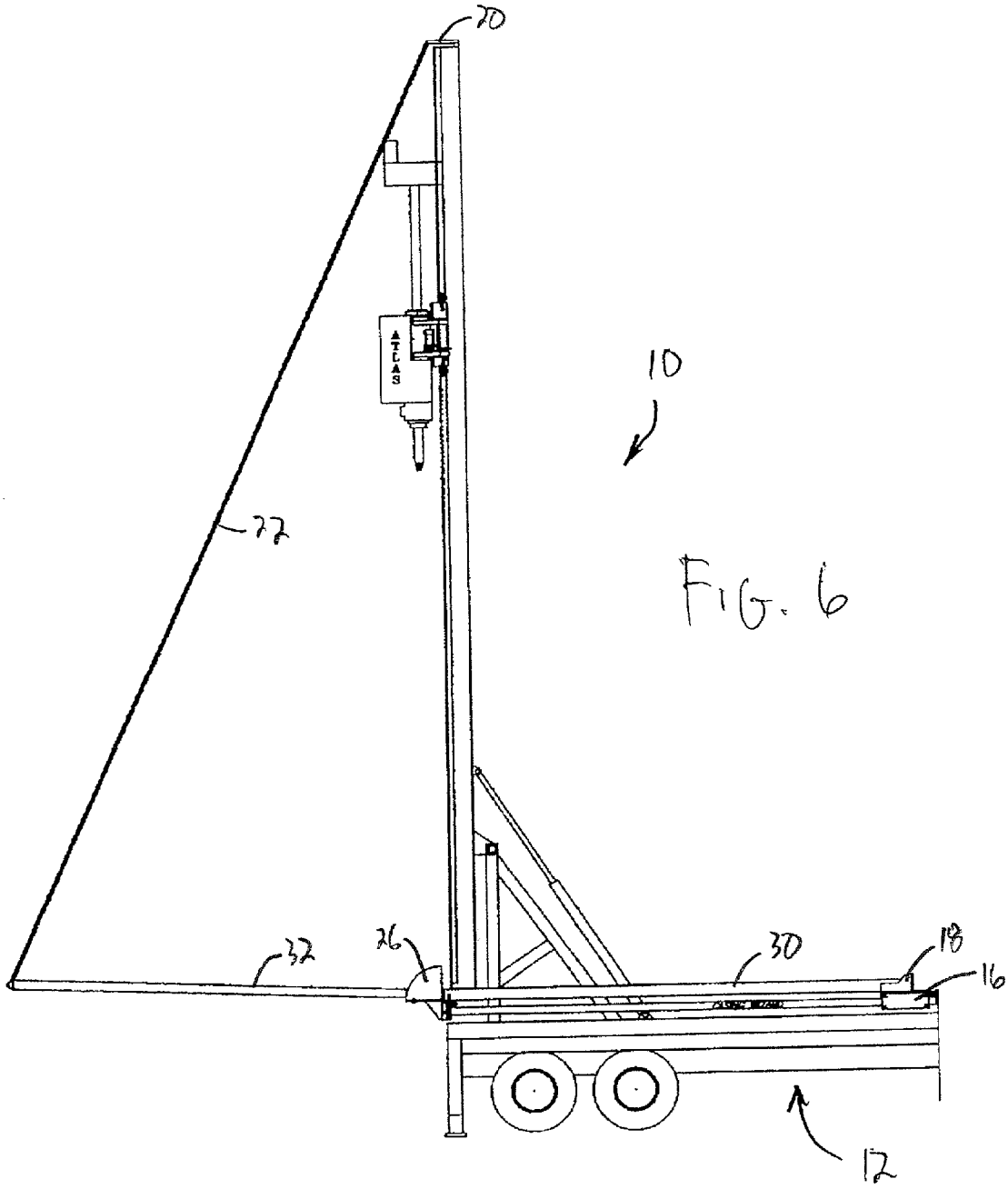
FIG. 6 shows the drill rod in its horizontal position with one end remaining in the drill rod guide and with the drill rod and the casing pipe being substantially coextensive.
Figure 7:
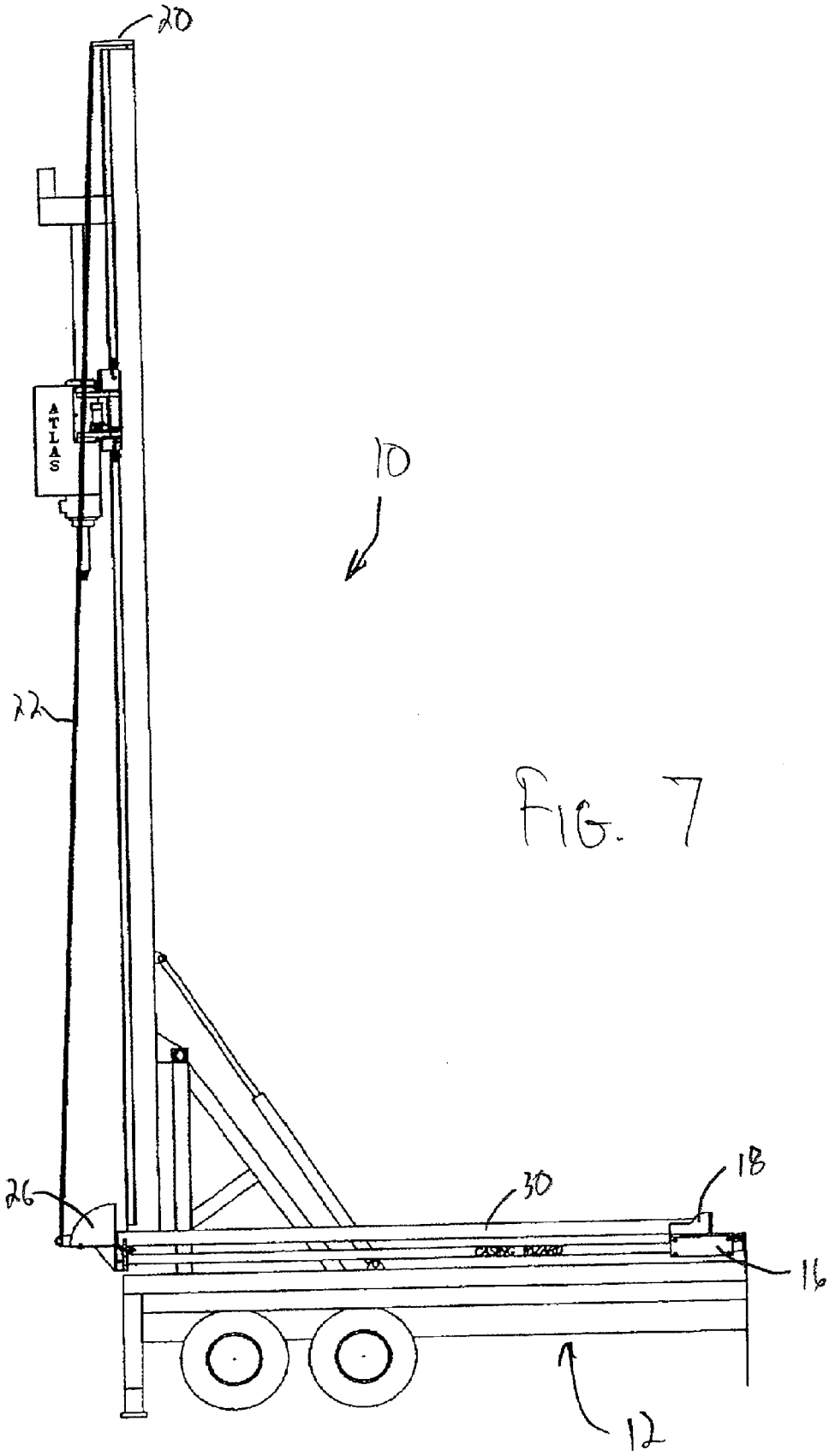
FIG. 7 illustrates the final step of sliding the drill rod into the casing pipe through the drill rod guide.

Then, an operator affixes the winch cable 22 of the top head winch 20 to a length of drill rod 32. The drill rod 32 is first positioned in a generally vertical orientation as shown in FIG. 3 with one end in the drill rod guide 24. Then, the top head winch 20 is used to lower the drill rod 32 to a substantially horizontal orientation as shown in FIGS. 4 through 6, with the one end remaining in the drill rod guide 24 until the drill rod 32 and the casing pipe 30 are substantially coextensive, as shown in FIG. 6. The drill rod 32 is then slid into the casing pipe 30 as shown in FIG. 7. Thereafter, the combination of the drill rod 32 and casing pipe 30 can be placed aside for later use, or can be lifted in position under a casing hammer 34 by means of the top head winch 20 for continued use in the well drilling process.

Various changes can be made to the invention without departing from the spirit thereof or scope of the following claims.

What is claimed:

1. A casing pipe and drill rod handler, comprising a. a casing pipe sled comprising an elongated track with a cart mounted on the track and slidable on the track between opposite ends of the track, b. a drill rod guide located at one end of the track, said drill rod guide being mounted in registration with said one end of the track and including opposite vertical sides spaced to accommodate a drill rod located between said sides, and c a casing pipe support fixed in relation to said track and substantially aligned with said track, said casing pipe support being fixed proximate said drill rod guide, said drill rod guide also being aligned with said casing pipe support.

2. The casing pipe and drill rod handler according to claim 1, in which the drill rod guide is formed to register one end of a drill rod inserted in the drill rod guide with a casing pipe located on said pipe sled.

3. A method of preloading a drill rod into a casing pipe, comprising the steps of a. orienting a length of casing pipe in a substantially horizontal position with a drill rod guide proximate one end of the casing pipe, b. positioning a drill rod in a generally vertical orientation with one end in the drill rod guide, c. lowering the drill rod to a substantially horizontal position with its one end remaining in the drill rod guide until the drill rod and the casing pipe are substantially coextensive, and d. sliding the drill rod through the drill rod guide and into the casing pipe.

4. The method according to claim 3 including repeating steps a-d for multiple casing pipes and drill rods.

* * * * *